US009982503B2

(12) United States Patent
Pallini et al.

(10) Patent No.: US 9,982,503 B2
(45) Date of Patent: May 29, 2018

(54) WELLHEAD METAL SEAL WITH ENERGIZING RING HAVING TRAPPED FLUID RELIEFS

(71) Applicant: Vetco Gray Inc., Houston, TX (US)

(72) Inventors: Joseph W. Pallini, Houston, TX (US); Rick C. Hunter, Houston, TX (US); David L. Ford, Houston, TX (US); Robert Jen-Yue Du, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 243 days.

(21) Appl. No.: 15/087,421

(22) Filed: Mar. 31, 2016

(65) Prior Publication Data

US 2017/0284165 A1 Oct. 5, 2017

(51) Int. Cl.
*E21B 33/04* (2006.01)
*E21B 33/00* (2006.01)

(52) U.S. Cl.
CPC ..... *E21B 33/04* (2013.01); *E21B 2033/005* (2013.01)

(58) Field of Classification Search
CPC ..... E21B 33/04
See application file for complete search history.

(56) References Cited

U.S. PATENT DOCUMENTS 8,205,890 B2 6/2012 Sundararajan
8,622,142 B2 1/2014 Shaw
8,668,021 B2 3/2014 Duong
8,851,185 B2 10/2014 Duong
8,997,883 B2 4/2015 Gette
2014/0069646 A1* 3/2014 Barnhart ..... E21B 33/03 166/285
2014/0110126 A1 4/2014 Yates
2014/0131054 A1 5/2014 Raynal et al.

OTHER PUBLICATIONS

OTC 6085—"High-Performance Metal-Seal System for Subsea Wellhead Equipment"—Offshore Technology Conference, Houston, Texas—May 1-4, 1989—author: L.J. Milberger, et al.
International Search Report and Written Opinion issued in connection with corresponding PCT Application No. PCT/US2017/25330 dated Jul. 5, 2017.

* cited by examiner

*Primary Examiner* — D. Andrews
*Assistant Examiner* — Kristyn A Hall
(74) *Attorney, Agent, or Firm* — Hogan Lovells US LLP

(57) ABSTRACT

A wellhead housing has a bore with an inner seal surface. A hanger with an outer seal surface lands in the bore. Wickers are formed on at least one of the seal surfaces. A metal seal ring lands between the seal surfaces, the seal ring having annular inner and outer legs separated by an annular slot. An energizing ring has inner and outer diameter surfaces that slide against the inner and outer legs of the seal ring when the energizing ring is moved downward in the slot to radially deform the inner and outer legs into sealing engagement with the wellhead housing and hanger. The energizing ring has an inner diameter relief and an outer diameter relief, each being a partially circumferential groove extending upward from a lower rim. The reliefs define a bridge of narrower radial thickness in the lower rim.

20 Claims, 4 Drawing Sheets

WELLHEAD METAL SEAL WITH ENERGIZING RING HAVING TRAPPED FLUID RELIEFS

FIELD OF THE DISCLOSURE

This disclosure relates in general to metal-to-metal wellhead seals, and in particular to an energizing ring for deforming a seal ring into a set position, the energizing ring having inner and outer diameter surfaces containing reliefs to prevent fluid from being trapped in wickers in the wellhead and hanger.

BACKGROUND

One type of subsea well has a wellhead housing at the sea floor. One or more casing hangers land in the bore of the wellhead housing, each secured to an upper end of a string of casing. After cementing the casing, a running tool sets a packoff or seal between the casing hanger and the wellhead housing.

One type of packoff has a metal ring with inner and outer legs separated by an annular slot. The running tool pushes an energizing ring into the slot, which radially deforms the inner and outer legs into sealing engagement with the wellhead housing and the casing hanger. One or both of the seal surfaces in the wellhead housing and on the casing hanger may have a set of wickers. The wickers are parallel grooves, each having a sharp crest. The sharp crests of the wickers embed into the seal ring surface when set with the energizing ring.

The wellhead housing will be filled with a liquid, which may be drilling fluid, before the seal ring sets. When the seal ring wall moves radially into engagement with the wickers, some of the liquid may be trapped in the wickers, forming a hydraulic lock. The trapped liquid can result in high pressure build up in the wickers, which restricts the depth that the wickers embed into the seal ring. The lesser depth or engagement can reduce the effectiveness of the seal ring.

SUMMARY

A wellhead seal assembly comprises a metal seal ring having annular inner and outer legs separated by an annular slot. An energizing ring inserts into the slot, the energizing ring having inner and outer diameter surfaces that extend upward from a lower end of the energizing ring. The inner and outer diameter surfaces engage the inner and outer legs of the seal ring to radially deform the inner and outer legs when the energizing ring is moved downward in the slot to a set position. At least one partially circumferential relief is on at least one of the inner and outer diameter surfaces of the energizing ring. The relief extends upward from the lower end a selected distance less than an axial dimension of the inner and outer diameter surface.

Because of the relief, the energizing ring does not deform part of the seal ring as much as other parts, preventing sealing engagement of a lower section of the seal ring with the wickers. The relieved area allows trapped liquid to flow out of the wickers during the setting process.

The relief may be located on the outer diameter surface, the inner diameter surface, or both. In the embodiment shown, at least one relief comprises an outer diameter relief on the outer diameter surface and an inner diameter relief on the inner diameter surface. The inner and outer diameter reliefs are located adjacent each other at a same angular position on the energizing ring. In the embodiment shown, there are two inner diameter reliefs and two outer diameter reliefs circumferentially spaced apart from each other.

The relief is a machined groove having a base surface that tapers upward from the lower end of the energizing ring, relative to the axis. In the embodiment shown, the relief has a curved upper edge. A circumferential length of the relief is greater than an axial dimension of the relief from the lower end of the energizing ring to a midpoint of the curved upper edge.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

Figure 1:
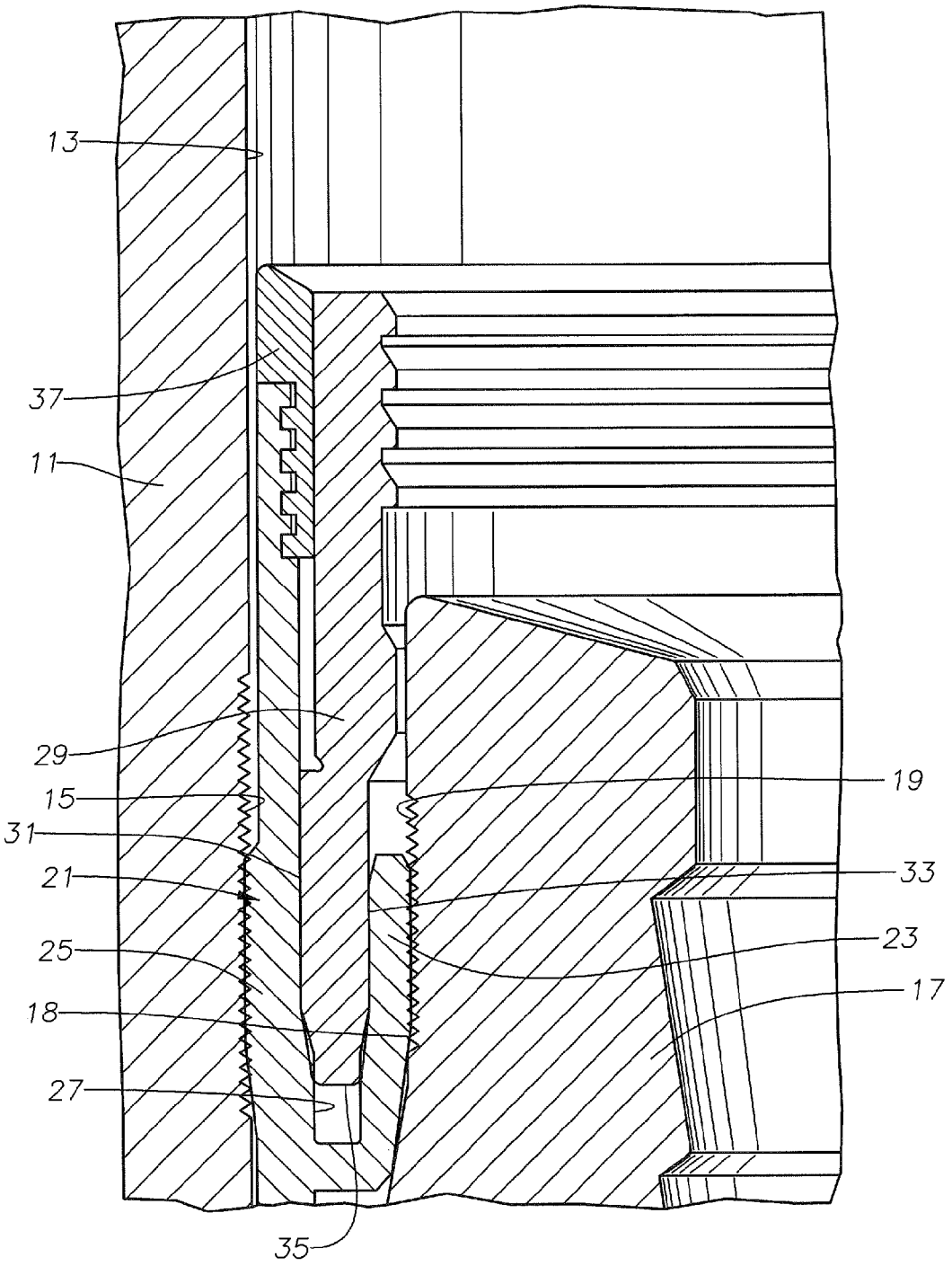
FIG. 1 is a sectional view of a portion of a wellhead assembly having a metal seal in accordance with this disclosure.

Referring to FIG. 1, wellhead housing 11 is a tubular member typically located on a sea floor at the upper end of a subsea well. Wellhead housing 11 has a bore with a cylindrical inner seal surface 13. In this example, inner seal surface 13 has a set of wickers 15. Wickers 15 are parallel, saw-tooth shaped grooves that join each other, each having a sharp crest.

A casing hanger 17 secured to an upper end of a string of casing (not shown) lands on a shoulder in the bore of wellhead housing 11. Casing hanger 17 has a cylindrical outer seal surface 18 spaced radially inward from wellhead housing seal surface 13. In this example, outer seal surface 18 also has a set of wickers 19. Wickers 19 may have the same configuration as wickers 15, but the axial length of wickers 19 may differ from the axial length of wickers 15.

In this embodiment, the axial length of wickers 15 is greater than the axial length of wickers 19. Optionally, wickers could be located on only one of the seal surfaces 13, 18.

After the casing (not shown) attached to casing hanger 17 has been cemented, the running tool positions a seal ring 21 in the pocket between wickers 15, 19. Seal ring 21 is an annular steel member with an annular inner wall or leg 23 and an annular outer wall or leg 25. An annular slot 27 extends between inner leg 23 and outer leg 25.

The seal assembly includes a metal energizing ring 29 that has an outer diameter surface 31 and an inner diameter surface 33. When a running tool (not shown) moves energizing ring 29 downward in slot 27, inner diameter surface 33 slides against inner leg 23 and outer diameter surface 31 slides against outer leg 25. The radial thickness of the portion of energizing ring 29 between outer diameter surface 31 and inner diameter surface 33 is greater than the radial width of slot 27. The downward movement of energizing ring 29 radially and permanently deforms inner and outer legs 23, 25. Outer leg 25 moves radially outward and embeds into wickers 15, foliating a sealing engagement. Inner leg 23 moves radially inward and embeds into wickers 19, forming a sealing engagement.

FIG. 1 shows energizing ring 29 in the lower set position, with outer and inner legs 25, 23 in sealing engagement with wickers 15, 19. While in the set position, a lower end or lower rim 35 of energizing ring 29 will be spaced above the lower end of slot 27. A retainer ring 37 secures to an upper portion of seal ring 21 to retain energizing ring 29 with seal ring 21 while energizing ring 29 is in an upper, run-in position or a retrieval position.

Figure 2:
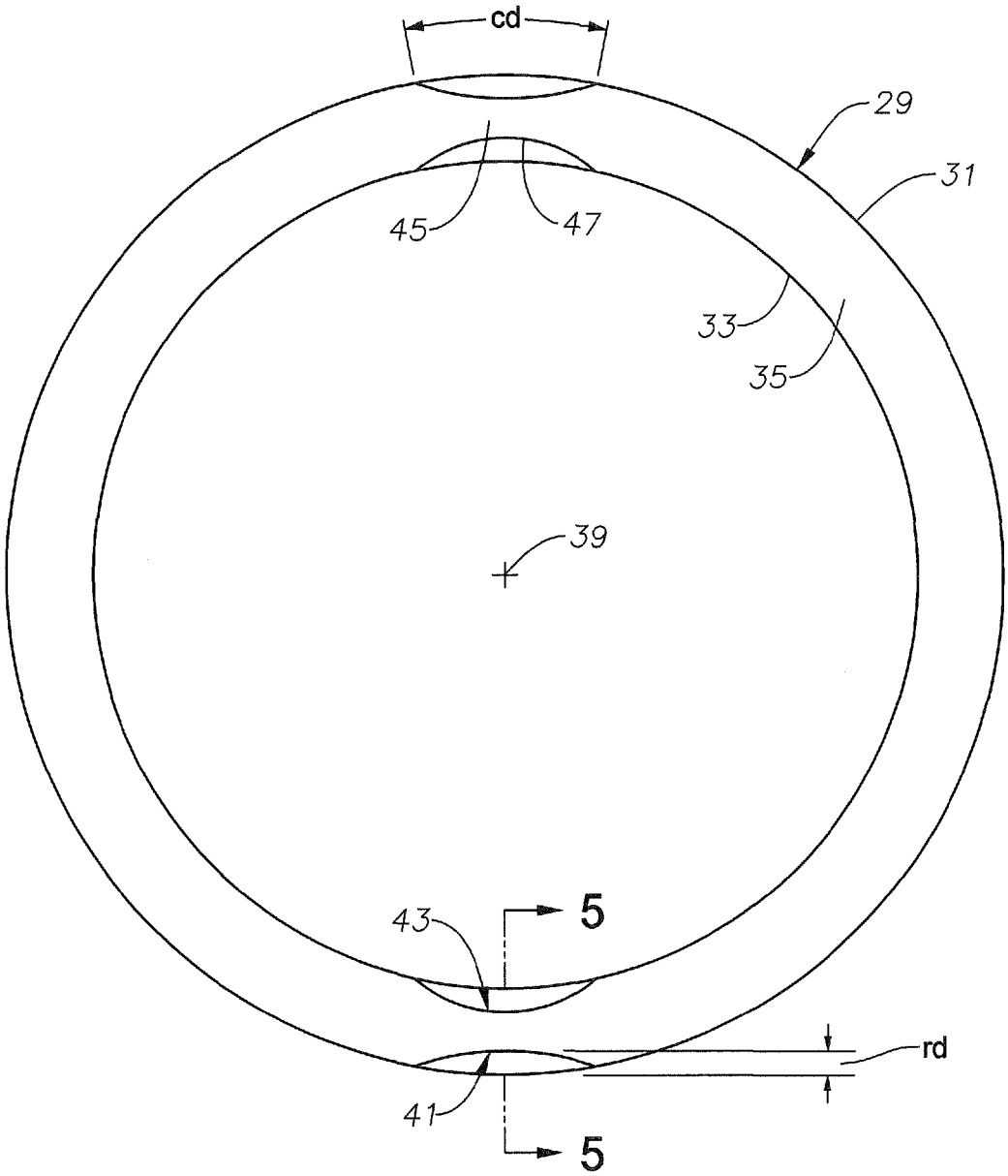
FIG. 2 is bottom view of the energizing ring of the metal seal of FIG. 1.

Referring to FIG. 2, energizing ring 29 has an axis 39 that coincides with an axis of wellhead housing 11 (FIG. 1). In this embodiment, energizing ring outer diameter surface 31 has at least one outer diameter relief 41 (two shown). Each outer diameter relief 41 is a machined undercut, partially circumferential groove, or scallop that joins lower rim 35 and extends upward a selected distance. In this example, energizing ring inner diameter surface 33 has at least one inner diameter relief 43. Each inner diameter relief 43 is a machined undercut, groove, or scallop that joins lower rim 35 and extends upward a distance that may be the same as outer diameter relief 41. Each outer diameter relief 41 may be located at the same angular position as one of the inner diameter reliefs 43. FIG. 2 shows one set of reliefs 41, 43 at a zero degree position and the other set at a 180 degree position. A midpoint of each outer diameter relief 41 may be on the same radial line as a midpoint of one of the inner diameter reliefs 43.

Each set of adjacent reliefs 41, 43 creates a bridge section 45 on lower rim 35 that is smaller in radial thickness than a remaining portion of lower rim 35. The radial thickness of bridge section 45 could be less than one-half a radial thickness of the remaining portion of lower rim 35, for example. In this example, each relief 41, 43 has a base surface 47 that appears curved when viewed from the bottom, as shown in FIG. 2. The curvature optionally may be symmetrical about a midpoint of each relief 41, 43. Alternately, base surface 47 of outer diameter relief 41 could be a flat surface.

The circumferential dimension cd of each base surface 47 measured along the circumference of outer diameter surface 31 or inner diameter surface 33 at lower rim 35 is much less than 360 degrees. As an example, the circumferential dimension cd of each relief 41, 43 is illustrated as being about 20 degrees, but that could differ. The circumferential dimension cd of base surface 47 of each outer diameter relief 41 may be about the same as the circumferential dimension cd of base surface 47 of each inner diameter relief 43. The circumferential distance between one outer diameter relief 41 and the other outer diameter relief 41 is much greater than the circumferential dimension cd of outer diameter relief 41.

The radial depth rd of each relief 41, 43, measured at lower rim 35 and a midpoint of each base surface 47 is at least equal to the radial depth of wickers 15 or 19. The radial depths rd of outer diameter reliefs 41 may be the same as the radial depths rd of inner diameter reliefs 43.

Figure 3:
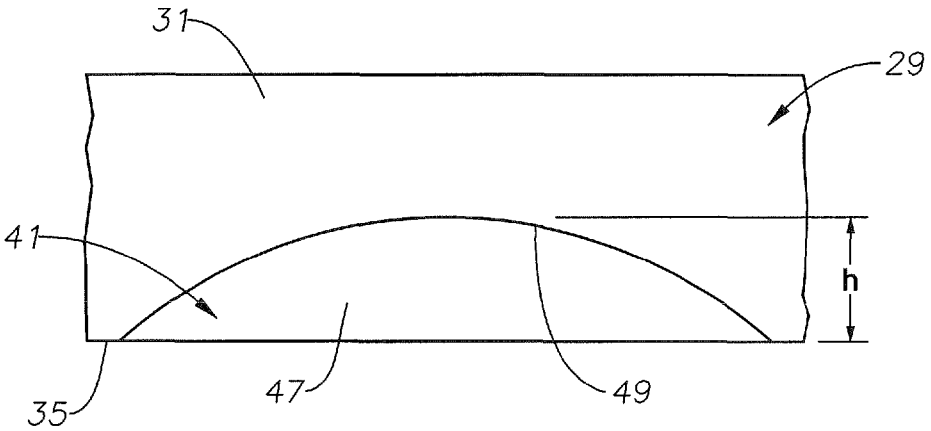
FIG. 3 is a side view of a fragment of the energizing ring of FIG. 2, showing a relief on an outer diameter of the energizing ring.

Referring to FIG. 3, in this embodiment, the upper termination of each outer diameter relief 41 is a symmetrically curved edge 49 about a midpoint. Curved upper edge 49 extends from lower rim 35 and has an apex a selected distance h from lower rim 35. The height or axial dimension h from lower rim 35 to the apex of curved upper edge 49 may vary, but preferably is about the same as an axial dimension of two or three of the wickers 15. The height h of each relief 41, 43 from lower rim 35 to a midpoint of curved upper edge 49 is much less than an axial dimension of outer diameter surface 31 and inner diameter surface 33. Instead of being curved, upper edge 49 could be a straight line parallel with lower rim 35.

Figure 4:
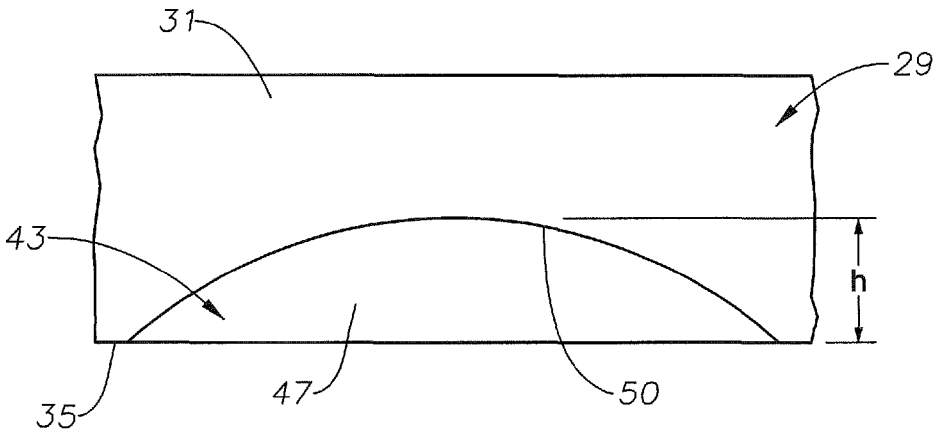
FIG. 4 is a side view of a fragment of the energizing ring of FIG. 2, showing a relief on an inner diameter of the energizing ring.

Referring to FIG. 4, similarly, the upper boundary of each inner diameter relief 43 is a symmetrically curved edge 50 about a midpoint. Curved upper edge 50 has a height h at its midpoint that is about the same as curved upper edge 49.

Figure 5:
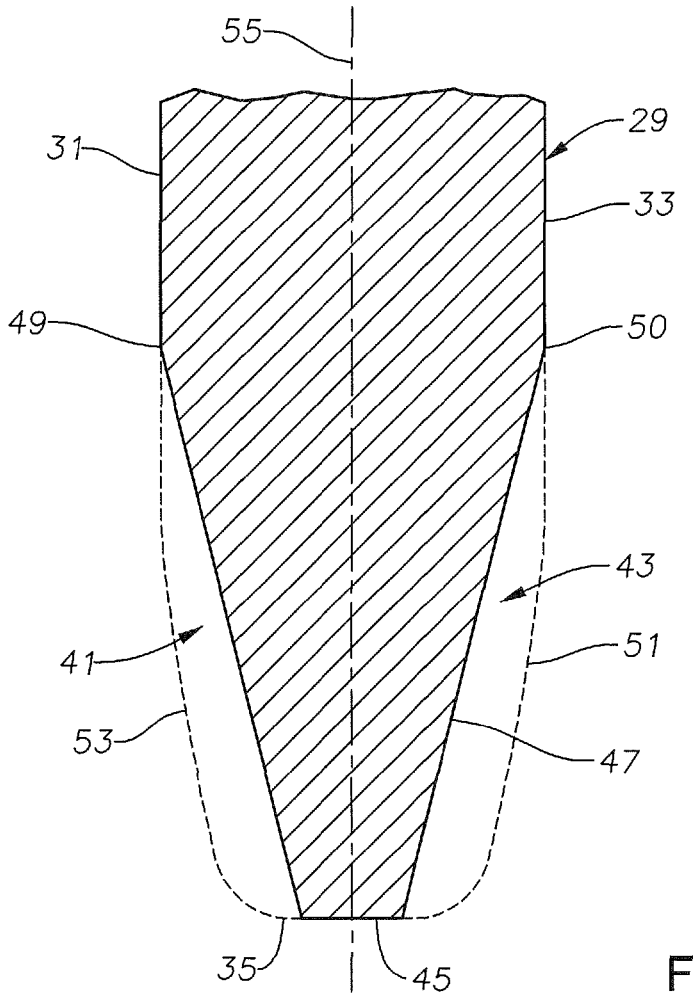
FIG. 5 is a sectional view of part of the energizing ring of FIG. 2, taken along line 5-5 of FIG. 2.
Figure 6:
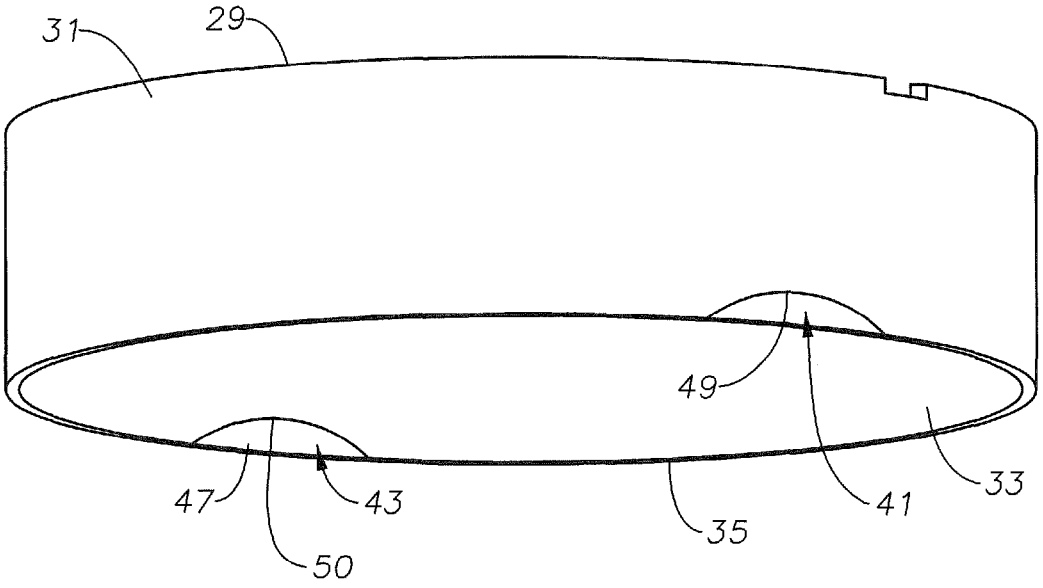
FIG. 6 is a perspective view of the energizing ring of FIG. 2.

Referring to FIG. 5, base surface 47 of each relief 41, 43 appear straight when viewed in an axial cross-section. FIG. 5 also illustrates with dotted lines the lower or nose section of energizing ring 29. The lower or nose section includes a gradually rounded inner diameter surface 51 and a gradually rounded outer diameter surface 53. The upper edges 49, 50 of reliefs 41, 43 may be about the same or slightly above the upper boundaries of lower inner and outer diameter surfaces 51, 53. A centerline 55, which is parallel with axis 39 (FIG. 2), is equidistant between outer and inner diameter surfaces 31, 33 and intersects a midpoint of bridge section 45. FIG. 6 illustrates a perspective view of energizing ring 29.

During the running operation, the bore of wellhead housing 11 will be filled with a liquid, which may be drilling fluid or mud. The liquid will immerse wickers 15, 19 before setting seal ring 21. The lower section of seal inner leg 23 has two circumferentially spaced apart portions, each radially inward from one pair of reliefs 41, 43. Each portion will not deform radially inward as far as the remaining circumferential part of the lower section of seal inner leg 23. These portions of seal ring inner leg 23 may contact wickers 19 but will not sealingly embed in wickers 19. This lower section, which only extends for two or three wickers, will not seal with two or three of the wickers of wickers 19. The lower section of seal outer leg 25 similarly does not embed and seal in the lowermost two or three wickers 15 because of reliefs 41.

Reliefs 43 do not affect the sealing engagement of the upper portion of seal ring inner leg 23 with wickers 19. Reliefs 41 do not affect the sealing engagement of the upper portion of seal ring outer leg 25 with wickers 15. For example, the upper portion of seal ring inner leg 23 will typically embed into and seal with six or seven of the wickers of wickers 19 The upper portion of seal ring outer leg 25 will typically embed into and seal with six or seven of the wickers of wickers 15.

The downward movement of energizing ring 29 causes seal ring inner leg 23 to seal gradually from the upper end downward. The gradual sealing forces any trapped liquid in the upper portion of wickers 19 downward into the lower portion of wickers 19. The prevention of sealing engagement of the lower section of seal ring inner leg 23 with the lowermost two or three wickers 19 allows in any trapped liquid in these lowermost wickers 19 to flow downward from wickers 19. The downward movement of energizing ring 29 causes sealing engagement of outer leg 25 with wickers 15 to occur simultaneously and in the same manner as inner leg 23.

It is to be understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

The invention claimed is:

1. A wellhead seal assembly, comprising:

a metal seal ring having an axis and annular inner and outer legs separated by an annular slot;

an energizing ring that inserts into the slot, the energizing ring having inner and outer diameter surfaces that extend upward from a lower end of the energizing ring and engage the inner and outer legs of the seal ring to radially deform the inner and outer legs when the energizing ring is moved downward in the slot to a set position; and at least one partially circumferential relief on at least one of the inner and outer diameter surfaces of the energizing ring, the relief extending upward from the lower end a selected distance less than an axial dimension of the inner and outer diameter surface.

2. The assembly according to claim 1, wherein:

the relief is located on the outer diameter surface.

3. The assembly according to claim 1, wherein:

the relief is located on the inner diameter surface.

4. The assembly according to claim 1, wherein:

said at least one relief comprises an outer diameter relief on the outer diameter surface and an inner diameter relief on the inner diameter surface.

5. The assembly according to claim 1, wherein:

said at least one relief comprises an outer diameter relief on the outer diameter surface and an inner diameter relief on the inner diameter surface, the inner and outer diameter reliefs being located adjacent each other at a same angular position on the energizing ring.

6. The assembly according to claim 1, wherein:

said at least one relief comprises at least two of the reliefs spaced circumferentially apart from each other.

7. The assembly according to claim 1, wherein said at least one relief comprises:

two outer diameter reliefs on the outer diameter surface circumferentially spaced apart from each other; and two inner diameter reliefs on the inner diameter surface circumferentially spaced apart from each other.

8. The assembly according to claim 1, wherein the relief comprises a groove that tapers upward and outward from the lower end of the energizing ring, relative to the axis.

9. The assembly according to claim 1, wherein:

the relief has a curved upper edge; and a circumferential dimension of the relief is greater than an axial dimension of the relief from the lower end of the energizing ring to a midpoint of the curved upper edge.

10. A wellhead assembly, comprising:

a wellhead housing having a bore with a longitudinal axis, the bore having an inner seal surface;

a hanger landed in the bore, the hanger having an outer seal surface;

a set of wickers formed on at least one of the seal surfaces;

a metal seal ring having annular inner and outer legs separated by an annular slot;

an energizing ring that inserts into the slot, the energizing ring having inner and outer diameter surfaces that extend upward from a lower rim of the energizing ring and slide against the inner and outer legs of the seal ring when the energizing ring is moved downward in the slot to radially deform the outer leg outward in sealing engagement with the inner seal surface and the inner leg inward into sealing engagement with the outer seal surface;

at least one inner diameter relief on the inner diameter surface and at least one outer diameter relief on the outer diameter surface, the inner diameter and outer diameter reliefs extending upward from the lower rim a selected distance less than an axial dimension of the inner and outer diameter surfaces, the inner diameter and the outer reliefs having circumferential dimensions less than 360 degrees; and wherein the outer diameter relief is located on a same radial line as the inner diameter relief, defining a bridge of narrower radial thickness in the lower rim than a remaining portion of the lower rim.

11. The assembly according to claim 10, wherein:

said at least one inner diameter relief comprises two of the inner diameter reliefs having midpoints spaced circumferentially apart from each other 180 degrees; and said at least one outer diameter relief comprises two of the outer diameter reliefs having midpoints spaced circumferentially apart from each other 180 degrees.

12. The assembly according to claim 10, wherein each of the inner diameter and outer diameter reliefs comprises a groove that tapers upward and outward from the lower end of the energizing ring.

13. The assembly according to claim 10, wherein:

each of the inner diameter and outer diameter reliefs has a curved upper edge; and a circumferential dimension of each of the inner diameter and outer diameter reliefs is greater than an axial dimension of each of the inner diameter and outer reliefs from the lower rim to a midpoint of the curved upper edge.

14. The assembly according to claim 10, wherein:

one of the walls of the seal ring embeds into the set of wickers when the energizing ring is in the set position except for a partially circumferential portion of said one of the walls adjacent the inner diameter and outer diameter reliefs, so as to enable trapped liquid in the wickers to flow downward at the partially circumferential portion.

15. The assembly according to claim 10, wherein:

an axial dimension of the inner diameter and outer diameter reliefs is less than one half an axial dimension of the set of wickers.

16. A method of setting a seal between a seal surface of a hanger and a seal surface of a wellhead having an axis, at least one of the seal surfaces having a set of wickers, the seal having a metal seal ring with annular inner and outer legs separated by an annular slot, the seal having an energizing ring with inner and outer diameter surfaces that extend upward from a lower end of the energizing ring; the method comprising:

providing at least one partially circumferential relief extending upward from the lower end of the energizing ring on a lower section of at least one of the inner and outer diameter surfaces;

moving the energizing ring downward in the slot, radially deforming the inner and outer legs of the seal ring to embed an upper section of one of the walls into sealing engagement with the set of wickers; and preventing a lower section of said one of the walls adjacent the relief from sealing engagement with the set of wickers to allow trapped liquid in a lower section of the wickers to flow out.

17. The method according to claim 16, wherein:

providing at least one partially circumferential relief comprises providing the relief with an axial dimension less than one-half an axial dimension of the set of wickers.

18. The method according to claim 16, wherein:

providing at least one partially circumferential relief comprises providing two of the reliefs circumferentially spaced apart from each other, and providing a circumferential distance between the reliefs that is greater than a circumferential dimension of either of the reliefs.

19. The method according to claim 16, wherein:

providing at least one partially circumferential relief defines a bridge portion of the lower end of the energizing ring that has less radial thickness than a remaining circumferential portion of the lower end of the energizing ring.

20. The method according to claim 16, wherein:

moving the energizing ring downward in the slot causes part of the lower section of said one of the walls to embed into the wickers while the part adjacent the relief does not embed into the wickers.

* * * * *